United States Patent [19]

Sasaki

[11] Patent Number: 4,898,472

[45] Date of Patent: Feb. 6, 1990

[54] PLANT OF BATCH SYSTEM FOR PRODUCING A COMPOSITE PAVING MATERIAL BY USING A BITUMINOUS WASTE PAVEMENT MATERIAL

[75] Inventor: Hideo Sasaki, Ageo, Japan

[73] Assignee: Taisei Road Construction Company, Ltd., Tokyo, Japan

[21] Appl. No.: 281,952

[22] Filed: Dec. 5, 1988

Related U.S. Application Data

[63] Continuation of Ser. No. 40,886, Apr. 21, 1987, abandoned.

[30] Foreign Application Priority Data

Apr. 25, 1986 [JP] Japan ..... 61-96168

[51] Int. Cl.[4] ..... B28C 5/20; B28C 5/46; B28C 7/04

[52] U.S. Cl. ..... 366/18; 366/23; 366/25; 366/142; 366/160; 366/162; 34/137; 432/105

[58] Field of Search ..... 106/281, 273 R; 404/95, 404/79; 34/135, 136, 137, 132; 432/103, 105; 366/4, 6, 7, 9, 8, 16, 18, 22, 23, 24, 25, 27, 30, 33, 54, 141, 142, 144, 147, 160, 162; 318/386

[56] References Cited

U.S. PATENT DOCUMENTS

| | | | |
|---|---|---|---|
| 774,860 | 11/1904 | Turney | 34/137 |
| 1,613,736 | 1/1927 | Andresen | 404/95 |
| 3,044,002 | 7/1962 | Lejon | 318/446 |
| 3,554,498 | 1/1971 | Laycock | 366/22 |
| 3,661,365 | 5/1972 | Cloud | 366/18 |
| 3,741,532 | 6/1973 | Farnham | 366/141 |
| 3,916,807 | 11/1975 | Elki | 432/105 X |
| 3,998,436 | 12/1976 | Allen | 366/18 |
| 4,165,184 | 8/1979 | Schlarmann | 366/24 X |
| 4,177,080 | 12/1979 | Mendenhall | 366/25 X |
| 4,255,058 | 3/1981 | Peleschka | 366/25 |
| 4,540,287 | 9/1985 | Servas et al. | 366/7 |
| 4,585,354 | 4/1986 | Thesenfitz | 366/25 |

*Primary Examiner*—Philip R. Coe
*Assistant Examiner*—K. O'Leary
*Attorney, Agent, or Firm*—Cushman, Darby & Cushman

[57] ABSTRACT

Disclosed is a plant of batch system for producing a composite paving material by using a bituminous waste pavement material, which comprises a heating means equipped with a new aggregate material introduction shoot and a bituminous waste material introduction shoot, the former shoot being connected to a new aggregate material supply passageway and the latter shoot being connected to a reproduction material supply passageway. The plant also comprises a ratio control section which is intended to compare with each other respective supplying indicated values of new and waste aggregate materials as measured by conveyor scales disposed with respect to their corresponding supply passageways, and thereafter proportionally control the value of the waste material relative to the value of the new material so that both the values may bear a predetermined mixing ratio. The ratio control section, thereafter, generates a command control signal to an inverter involved in the waste material supply passageway.

1 Claim, 2 Drawing Sheets

PLANT OF BATCH SYSTEM FOR PRODUCING A COMPOSITE PAVING MATERIAL BY USING A BITUMINOUS WASTE PAVEMENT MATERIAL

This is a continuation of application Ser. No. 040,886, filed Apr. 21, 1987, which was abandoned upon the filing hereof.

BACKGROUND OF THE INVENTION

1. Field of the invention

Composite material production plants are, roughly classified into two types, one of which is a dryer mixing type of continuous system and the other of which is a batcher mixing type of batch system.

The present invention relates to a plant of batch system for producing a composite paving material by using a bituminous waste pavement material and, more particularly, to a plant of batch system wherein a new aggregate material is heated and a bituminous waste material that is not heated are mixed together at a predetermined ratio and the resultant mixture is heated to produce a composite material for use as a bituminous reproduction mixture.

2. Description of the Prior Art

There existed in the prior art no plant of batch system which, at the time of producing a composite material using a bituminous waste pavement material, can collectively execute all of the heating means wherein a new aggregate material as heated and a bituminous waste material as not heated are mixed together at a predetermined mixing ratio and heated, the material supplying means for supplying the new and waste materials up to the heating means, the setting/adusting means wherein the mixing ratio of one to the other of the new and waste materials is set as predetermined and both materials are so quantitatively adjusted as to bear the predetermined ratio, and the other means.

Under the above-mentioned actual circumstances, the following problems have hitherto been raised in regard to conventional production of a composite material which uses a bituminous waste pavement material.

As mentioned above, no heating means in which the new aggregate material which has been heated and the bituminous waste material which has not been heated are mixed together at a predetermined ratio has ever existed. For this reason, the amounts of both the materials were measured at separate positions, respectively, and then both the materials were introduced into a hopper by way of the same sieving device. This made it difficult to keep the predetermined reasonable mixing ratio to be unvaried, resulting in a possible decrease in the reliability as placed upon the quality of the resulting composite-material product.

SUMMARY OF THE INVENTION

The present invention has been made in order to solve the above mentioned problems inherent in the prior art and the object thereof is to provide a plant of batch system for producing a composite material by using a bituminous waste pavement material, which is capable of collectively and interlockingly executing, in a state wherein their positions remain to be unchanged, a function of a supply means for supplying a new aggregate material as heated and a bituminous waste material as not heated in a state wherein both the materials rationally bear a predetermined mixing ratio therebetween, a function of a heating means for causing both the materials supplied from the supply means to be mixed together and heated within the same device, and a function of a setting/adjusting means for strictly setting the mixing ratio, and causing both the materials to be quantitatively adjusted in view of the mixing ratio, with respect to the supply means provided extending up to the heating means. The characterizing feature of the present invention lies in a plant of batch system for producing a composite paving material by using a bituminous waste pavement material, which comprises a heating means which includes a rotary cylindrical body kept in a lengthwise posture inclined in the vertical direction and mounted, on its inner top and bottom surfaces, with agitating blades, the heating means having an elevated opening section over which there is loosely fitted an elevated wall member equipped with a new aggregate material introduction chute, and a lowered opening section over which there is loosely fitted a lowered wall member equipped with a bituminous waste material introduction shoot and also equipped, at its central part, with a burner; a new-aggregate material supply passageway which is connected to the new aggregate material introduction chute and which is intended for supplying a new aggregate material from a new aggregate material feeder to the new aggregate material introduction chute through an arrangement of conveyors, said arrangement of conveyors including, among them, a new aggregate material conveyor scale equipped with an amount-of-new-aggregate-material indicating device; a reproduction material supply passageway which is connected to the bituminous waste material introduction chute and which is intended for supplying a bituminous waste pavement material from a bituminous waste material feeder, which permits the flow rate of its said waste material to be adjusted by an inverter, to the bituminous waste material introduction chute through another arrangement of conveyors, the arrangement of conveyors including, at a terminal end of its arrangement, a bituminous waste material conveyor scale equipped with an amount-of-reproduction-material indicating device; and a ratio control section which is connected between the inverter and the amount-of-new-aggregate-material indicating device so that it may be changeable over from its automatic interlocking operation to a manual independent operation and vice versa, and which is intended for making a comparison between respective supplying indicated values of the new arregate material and waste reproduction material and thereby proportionally controlling the value of the waste material relative to the value of the new material so that both the values may bear a predetermined ratio, whereby to generate a command control signal to the inverter.

Where a new aggregate material and a bituminous waste material are mixed together and heated by the heating means of the present production plant having the described construction so as to produce a composite material for use as a bituminous reproduction mixture, introduction of the new aggregate as already heated into the new aggregate material feeder enables that new aggregate material to be supplied with high precision into the heating means. This is because the new aggregate material supply passageway constituted by the arrangement of conveyors is provided extending from a position right beneath the new aggregate material feeder up to a position in which the new aggregate material introduction shoot of the heating means is located, and in addition because the new aggregate material conveyor scale equipped, at the position of the ratio control section, with the amount-of-new aggregate-material indicating device is disposed in the mid course of the new aggregate material supply passageway. Similarly, introduction of the bituminous waste reproduction material as not heated into the bituminous waste material feeder also enables that reproduction material to be supplied with high precision into the heating means. This is because the waste reproduction material supply passageway constituted by the second arrangement of conveyors is provided extending from a position right beneath that feeder up to a position in which there is located the bituminous waste material introduction chute mounted on the lowered wall member loosely fitted over the lowered opening section of the heating means, and in addition because the bituminous waste material conveyor scale equipped, at the position of the ratio control section, with the amount-of-reproduction-material indicating device is disposed in the terminal end of the waste reproduction material supply passageway. In this way, the supplying amounts of both the materials thus respectively supplied into the introduction chutes of the heating means are respectively previously measured by their corresponding conveyor scales and thus are exactly indicated by their corresponding indicator devices When the unit amount of each material being supplied into the heating means has failed to be in conformity with a predetermined mixing ratio set beforehand, the control function of the ratio control section works to automatically control the inverter. As a result, the rate at which the material is fed from the feeder into the waste reproduction material supply passageway can interlockingly be so adjusted as to be in conformity with the predetermined mixing ratio set beforehand. Thus, the aggregate material which is stored in a heated receptacle by way of the above plant can contain a specified amount of asphalt, so that addition of an increased or decreased amount of asphalt as compared with the amount of aggregate material would make it possible to obtain the same quality of reproduction aggregate material.

DESCRIPTION OF THE PREFERRED EMBODIMENT

An embodiment of the present invention will now be described with reference to the drawings.

A composite-material production plant of the invention comprises a heating means composed of a heating device 1, a new aggregate material supply means disposed along a new aggregate material passageway A, a bituminous waste material supply means disposed along a waste reproduction material supply passageway B, and a setting/adjusting means composed of a ratio control section 18 for setting beforehand a predetermined mixing ratio of a bituminous waste material to the indicated value of a new aggregate material and quantitatively proportionally adjusting the former relative to the latter while making a comparison therebetween so as for the two to bear the predetermined mixing ratio.

Figure 1:
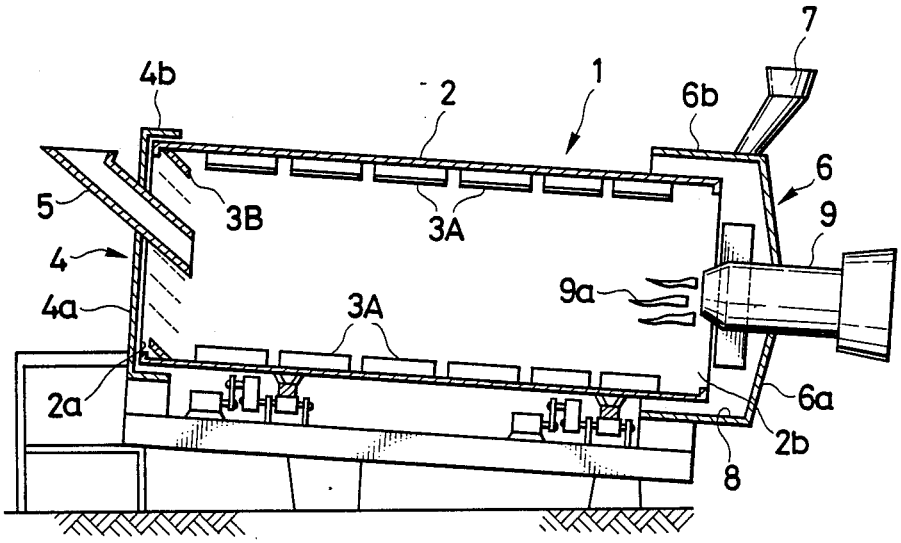
FIG. 1 is a vertically sectional side view showing a heating means constituting an essential portion of a composite material production plant according to the present invention.

First of all, the heating device 1 which constitutes the heating means has the following construction. As shown in FIG. 1, at an intermediate part of the heating device 1 there is disposed a rotary cylinder 2 of specified diameter so that the same may be freely rotatable by being connected to an external drive source mounted on a bottom-side base of the heating device 1. The rotary cylinder 2 is disposed such that its lengthwise posture is inclined in the vertical direction, or upward direction of the illustration. On the other inner surface of the rotary cylinder 2 than those in the respective vicinities of an elevated opening section 2*a* and a lowered opening section 2*b* of the latter there are mounted a multiplicity of agitating blades 3A having an equal height as viewed from said inner surface, in such a manner that they are arranged at suitable intervals as taken both in the circumferential direction and in the longitudinal direction. It should be noted here that nonreturn or check blades 3B are mounted on the inner surface portion of the rotary cylinder 2 in the vicinity of the elevated opening section 2*a* thereof in such a manner that they are disposed at suitable intervals as taken in the circumferential direction.

Fitted over the elevated opening section 2*a* of the rotary cylinder 2 is an elevated wall member 4 fixedly mounted on the bottom-side base of the heating device 1. The elevated wall member 4 has a circular wall plate 4*a* which is integrally formed, at its peripheral edge, with an annular wall 4*b*. This annular wall 4*b* is loosely fitted over the rotary cylinder 2, whereby it is prevented from being brought into sliding contact with the latter at the time when the same is rotated. Further, the elevated wall member 4 is equipped with a new aggregate material introduction chute 5 for introducing a new aggregate material into the rotary cylinder 2.

Fitted over the lowered opening section 2*b* of the rotary cylinder 2 is a lowered wall member 6 fixedly mounted on the bottom-side base of the heating device 1. The lowered wall member 6 has a circular wall plate 6*a* which is integrally formed, at its peripheral edge, with an annular wall 6*b*. This annular wall 6*b* is loosely fitted over the rotary cylinder 2, whereby it is prevented from being brought into sliding contact with the latter at the time when the same is rotated. And the lowered wall member 6 is equipped with a bituminous waste material introduction shoot 7 for introducing a bituminous waste material (reproduction material) into the rotary cylinder 2. It shoud be noted here that the lowered wall member 6 is equipped, at its lower portion, with a composite-material discharge port (not shown) for discharging a bituminous reproduction aggregate material mixture (composite material) outside the heating device 1. Also, at an inner bottom portion of the lowered wall member 6 is disposed an annular groove 8 wherein the new aggregate material having been allowed, while heated within the rotary cylinder 2, to flow down to the lowered opening section 2*b* is mixed with the bituminous waste material having been introduced from the bituminous waste material introduction chute 7, whereby the latter material is heated by the former material through a heat-exchanging action occurring therebetween to produce the composite material for use as a bituminous reproduction aggregate material mixture. At the central part of the lowered wall member 6 is installed a burner 9 so that its flame 9*a* may be irradiated into the rotary cylinder 2.

Figure 2:
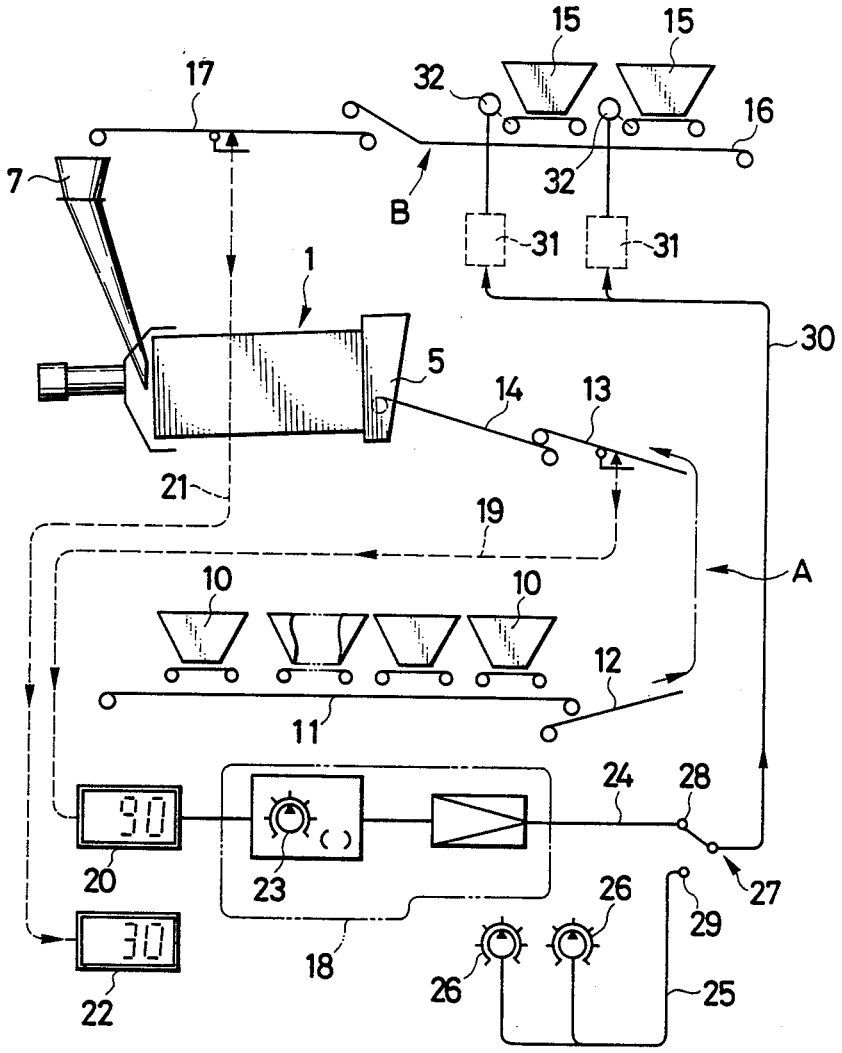
FIG. 2 is a circuit diagram showing the disposition of respective essential portions of the composite material production plant according to the present invention.

Connected to the new aggregate material introduction chute 5 of the above-constructed heating device 1 is a new aggregate material supply passageway A serving as a supply means for new aggregate material, said passageway A having the following construction. As shown in FIG. 2, at a starting end position of the new aggregate material supply passageway A are disposed at suitable intervals a plurality of new aggregate material feeders 10 equipped, beneath their openings, with extruding conveyors. Beneath those new aggregate material feeders 10 is laid a continuous conveyor 11, from the position of which up to the new aggregate material introduction chute 5 of the heating device 1, a multiplicity of conveyors 12 to 14 including among them a new aggregate material conveyor scale 13 are continuously arranged so as to permit the new aggregate material not shown to be sequentially conveyed and fed, through cooperations of conveyors, to the new aggregate material introduction chute 5. It should be noted here that the new aggregate material conveyor scale 13 is so arranged as to detect through a physical sensing of pressure the weight of the new aggregate material under conveyance on the conveyor arrangement, the weight thus detected being supplied, in the form of an electric signal, to a new aggregate-material-amount indicating device 20 as later described.

Connected to the bituminous waste material introduction chute 7 of the heating device 1 is a waste reproduction material supply passageway B serving as a supply means for bituminous waste material, said passageway B having the following construction. Namely, at a starting end position of the passageway B are disposed at suitable intervals a plurality of bituminous waste material feeders 15 equipped, beneath their openings, with extruding conveyors which are connected with motors for adjustment of their feeding speed. A continuous elongate conveyor 16 is installed right beneath the bituminous waste material feeders 15. Between the conveyor 16 and the shoot 7 of the heating device 1 is disposed a bituminous waste material conveyor scale 17 in a continuous manner, by way of which the bituminous waste material (reproduction material) not shown can be conveyed and fed, through cooperations of conveyors, to the bituminous waste material introduction chute 7. The abovementioned conveyor scale 17 is so arranged as to detect through a physical sensing of pressure the weight of the bituminous waste material under conveyance on the conveyor arrangement, the weight thus detected being supplied, as an electric signal, to a reproduction-material-amount indicating device 22 as later described. Further, the motor 32 of each said bituminous waste material feeder 15 is connected with an inverter 31 at a position corresponding to that of the motor. Whereby, the rotational speed of the motor 32 can be changed in response to an electric command signal from a ratio control section 18 as later described, so as to make it possible to adjust the feeding rate at which the bituminous waste material is fed from the feeders 15.

Connected to the new aggregate material conveyor scale 13 via an electric line 19 is the new-aggregate-material-amount indicator 20 for indicating the supplying amount of new aggregate material as measured by the above-mentioned conveyor scale 13. Further, connected to the bituminous waste material conveyor scale 17 via an electric line 21 is the reproduction-material amount indicator 22 for indicating the supplying amount of bituminous waste material as measured by the above-mentioned conveyor scale 17.

Between the indicator 20 and the inverters 31 there is disposed a control means which is constituted by the ratio control section 18. In this control section 18, whether or not the bituminous waste material meeting the requirement of a predetermined mixing ratio set beforehand is being fed to the heating device 1 is determined as compared with the value indicated on the new-aggregate-material-amount indicator 20. Thereafter, the rotational speeds of the motors 32 for the feeders 15 are proportionally controlled in accordance with the compared value by way of the inverters 31. The ratio control section 18 has a supplying-amount-of-material setting dial device 23, one end of which is electrically connected to the new-aggregate-material-amount indicator 20 and the other of which is connected to the inverters 31 via an electric line 24, 30 provided midway with a change-over switch 27. This switch 27 has two contacts, one being a contact 28 which is connected to the ratio control section 18 for permitting automatic setting operation and the other being a contact 29 which is connected, via an electric line 25, with a plurality of supplying-amount-of-material setting dial devices 26 for the purpose of permitting the amount of bituminous waste material fed from the feeders 15 to be independently set by way of manual setting operation. The position of the automatic contact 28 is located on the same circumference as that on which the position of the manual contact 29 is located, whereby the former contact can be changeable over to the latter or vice versa. Thus, the change-over switch 27 is incorporated as one constituent element into the composite-material production plant which as a whole is operable in the form of one unit.

When the new aggregate material and the bituminous waste material are mixed together and heated by use of the heating device 1 of the above-constructed plant to produce a composite material as the aggregate material constituting a bituminous reproduction mixture, the plant operates as follows. First of all, a specified amount of new aggregate material is supplied from the feeders 10 to the heating device 1 via the introduction chute 5 thereof by way of the arrangement of conveyors 11, 12,—14 provided midway with the new aggregate material conveyor scale 13. Then, it is allowed to flow down to the lowered opening section **2*b* while it is being heated with the flame 9*a* of the burner 9 in the device 1. On the other hand, a specified amount of bituminous waste material which bears a predetermined mixing ratio with respect to said amount of new aggregate material is simultaneously supplied from the feeders 15 of the reproduction material supply passageway B to the heating device 1 via the introduction chute 7 thereof by way of the arrangement of conveyors including at its terminal end the bituminous waste material conveyor scale 17. Thus, the new aggregate material and the bituminous waste material are mixed together at the position of annular groove 8**. At this time, a heat-exchanging action occurs between the to materials, whereby the waste material also is heated. This makes it possible to produce from the discharge port not shown the composite aggregate material, constituting a bituminous reproduction mixture, which satisfies the requirement of a predetermined mixing ratio between the two constituent materials.

To explain in more detail, when the new aggregate material not shown has been introduced into the feeders 10 of the new aggregate material supply passageway A, it can be supplied with high precision into the heating device 1 while it is quantitatively indicated on the indicator 20. A reason for this is that the new aggregate material supply passageway A composed of the arranged conveyors 11, 12,—14 is disposed extending from the position right beneath the feeders 10 to the new aggregate material introduction chute 5 of the heating device 1. A second reason is that the supply passageway A is provided midway with the new aggregate material conveyor scale 13 equipped, at the position of the ratio control section 18, with the new-aggregate-material-amount indicator 20.

On the other hand, when the reproduction material (not shown) constituted by the bituminous waste material as not heated has been introduced into the feeders 15 of the bituminous waste material supply passageway B, it can also be supplied with high precision into the heating device 1 while it is quantitatively indicated on the indicator 22. A reason for this is that the reproduction material supply passageway B composed of the arranged conveyors 16—is disposed extending from the position right beneath the feeders 15 to the bituminous waste material introduction chute 7 of the heating device 1. A second reason is that the supply passageway B is provided, at its terminal end, with the bituminous waste material conveyor scale 17 equipped, at the position of the ratio control section 18, with the bituminous-waste-material-amount indicator 22.

The amounts of the new and waste aggregate materials having been thus supplied into their respective chutes 5 and 7 are previously measured by their respective conveyor scales 13 and 17 of their corresponding supply passageways A and B and then can exactly be indicated on their respective indicators 20 and 22. In this case, if the amount of bituminous waste material has failed, due to its exess or shortage, to bear a predetermined mixing ratio set beforehand in the ratio control section 18 with respect to the value indicated of the amount of new aggregate material having been supplied into the chute 5 of the heating device 1, the ratio control section 18 will perform its control function to automatically control the inverters 31. Whereby, the rotational speed of the motors 32 connected to those inverters 31 is automatically changed. This makes it possible to interlockingly adjust the speed of the extruding conveyors for the feeders 15 in the supply passageway B so as for it to conform with said predetermined mixing ratio. This enables an efficient production of a composite material which is always of high quality When the change-over switch 27 provided in the proximity of the ratio control section 18 is brought into contact with the automatic contact 28, the ratio control section 18 operates to enable an easy and reliable adjustment, in interlocking relationship with the other essential part, of the supplying amount of bituminous waste material from the feeders 15. On the other hand, when the switch 27 is changed over to the manual contact 29, it is possible to independently set the supplying amount of bituminous waste material from the feeders 15 by operating the suppling-amount setting dial device 26 disposed on the electric line 25 involved.

This invention is characteristically directed to the plant of batch system for producing a composite paving material by using a bituminous waste pavement material, which comprises the heating means which includes the rotary cylindrical body kept in the lengthwise posture inclined in the vertical direction and mounted, on its inner top and bottom surfaces, with the agitating blades, said heating means having the elevated opening section over which there is loosely fitted the elevated wall member equipped with the new aggregate material introduction chute, and the lowered opening section over which there is loosely fitted the lowered wall member equipped with the bituminous waste material introduction chute also equipped, at its central part, with the burner; the new-aggregate material supply passageway which is connected to the new aggregate material introduction chute and which is intended for supplying a new aggregate material from the new aggregate material feeder to the new aggregate material introduction chute through the arrangement of conveyors, the arrangement of conveyors including, among them, the new aggregate material conveyor scale equipped with the amount-of-new-aggregate indicating device; the reproduction material supply passageway which is connected to the bituminous waste material introduction chute and which is intended for supplying a bituminous waste pavement material from the bituminous waste material feeder, which permits the flow rate of its said waste material to be adjusted by the inverter, to the bituminous waste material introduction chute through the second arrangement of conveyors, the arrangement of conveyors including, at the terminal end of its arrangement, the bituminous waste material conveyor scale equipped with the amount-of-reproduction-material indicating device; and the ratio control section which is connected between the inverter and the amount-of-new-aggregate-material indicating device so that it may be changeable over from its automatic interlocking operation to the manual independent operation and vice versa, and which is intended for making a comparison between respective indicated values of the new aggregate material and waste reproduction material and thereby proportionally controlling the value of the waste material relative to the value of the new material so that both the values may bear a predetermined ratio, whereby to generate a command control signal to the inverter. Therefore, it is possible to collectively and interlockingly execute, in a state wherein their positions remain to be unchanged, the supply means for supplying a new aggregate material as heated and a bituminous waste material as not heated in a state wherein both the materials rationally bear a predetermined mixing ratio therebetween by incorporation of the conveyor scales, etc., the heating means for causing both the materials supplied from the supplying means to be mixed together and heated within the same device, and the setting/adjusting means for strictly setting the mixing ratio, and causing both the materials to be quantitatively adjusted in view of the ratio, with respect to the supply means extending up to the heating means. Thus, the invention has the effect of producing a composite material always of high quality to greatly enhance the reliability as placed upon that material using a bituminous waste pavement material.

What is claimed is:

1. A batch system plant for producing a composite paving material by using a bituminous waste pavement material, comprising:

a heating means which includes a rotary cylindrical body in a lengthwise configuration, inclined in a vertical direction, having a top and bottom and mounted, on its inner top and bottom surfaces, with agitating blades, said heating means having an elevated opening section over which there is loosely fitted an elevated wall member equipped with a new aggregate material introduction chute, and a lowered opening section over which there is loosely fitted a lowered wall member equipped with a bituminous waste material introduction chute separate from said rotary cylindrical body and also equipped, at its central part, with a burner which heats the new aggregate material;

a new-aggregate material supply passageway which is connected to said new aggregate material introduction chute and which supplies said new aggregate material from a new aggregate feeder to said new aggregate material introduction chute through a first arrangement of conveyors, said arrangement of conveyors including, among them, a new aggregate material conveyor scale equipped with an amount-of-new-aggregate-material indicating device;

a reproduction material supply passageway which is connected to said bituminous waste material introduction chute and which supplies a bituminous waste pavement material from a bituminous waste material feeder having an inverter which adjusts the flow rate of said waste material, to said bituminous waste material introduction chute through a second arrangement of conveyors, said second arrangement of conveyors including, at a terminal end of its arrangement, a bituminous waste material conveyor scale equipped with an amount-of-reproduction-material indicating device, said new aggregate material and said bituminous waste material being mixed together and then heated to form said composite paving material; and a ratio control section which is connected between said inverter and said amount-of-new-aggregate-material indicating device having an automatic interlocking operation which can be changed to a manual independent operation and vice versa, and which makes a comparison between respective indicated supplying values of said new aggregate material and waste reproduction material and thereby proportionally controlling the value of the waste material relative to the value of the new material so that both said values may bear a predetermined ratio, to generate a command control signal to said inverter for controlling the supply and ratio of said heated new-aggregate and unheated bituminous waste material.

* * * * *